US005245502A

United States Patent [19]

Genovese

[11] Patent Number: 5,245,502

[45] Date of Patent: Sep. 14, 1993

[54] SEMI-CONDUCTOR CORONA GENERATOR FOR PRODUCTION OF IONS TO CHARGE A SUBSTRATE

[75] Inventor: Frank C. Genovese, Fairport, N.Y.

[73] Assignee: Xerox Corporation, Stamford, Conn.

[21] Appl. No.: 617,223

[22] Filed: Nov. 23, 1990

[51] Int. Cl.[5] ..... H01T 19/04

[52] U.S. Cl. ..... 361/225; 355/219

[58] Field of Search ..... 250/324–326, 250/423 R, 423 F; 361/229–233; 355/225, 219

[56] References Cited

U.S. PATENT DOCUMENTS

| | | | |
|---|---|---|---|
| 2,777,957 | 1/1957 | Walkup | 250/49.5 |
| 3,729,649 | 4/1973 | LaChappelle et al. | 317/4 |
| 4,562,447 | 12/1985 | Tarumi et al. | 346/159 |
| 4,779,107 | 10/1988 | Weisfield et al. | 346/159 |
| 4,783,716 | 11/1988 | Nagase et al. | 361/225 |
| 4,794,254 | 12/1988 | Genovese et al. | 250/324 |
| 4,811,158 | 3/1989 | Kani et al. | 361/230 |
| 4,879,569 | 10/1989 | Kubelik | 346/159 |
| 4,975,579 | 12/1990 | Iwaruga | 250/324 |

*Primary Examiner*—A. D. Pellinen
*Assistant Examiner*—Aditya Krishnan
*Attorney, Agent, or Firm*—Denis A. Robitaille

[57] ABSTRACT

The device has a glass-like substrate of variable configurations. Three layers of thin paint-like material is uniformly deposited upon the substrate. The first and third layers are an electrically resistive material, the second layer is a dielectric material. An air gap, descending through all three layers, runs the width of the device. Thus, in operation, energizing the resistive layers in varying configurations of potentials will strike a gaseous plasma in a narrow gap thus ionizing air molecules. In the preferred arrangement, a high potential is applied to the first or innermost resistive layer to strike a plasma and generate ions. A fraction of these ions flow outwardly through the gap past the third or outer resistive layer and may be accelerated to the charging charge retentive surface. By specifying the third or outer layer's potential, the flow of ions to the charge retentive surface is regulated (acting like a control grid) such that ion flow will proceed only until the charge retentive surface potential reaches equality with that applied to the third or outer layer. Further charging ceases and the charge retentive surface is left with a uniform potential equal to that applied to the third or outer layer. Thus the device can be advantageously applied to charge or discharge surfaces to very uniform predetermined potentials in an electrographic apparatus.

17 Claims, 6 Drawing Sheets

SEMI-CONDUCTOR CORONA GENERATOR FOR PRODUCTION OF IONS TO CHARGE A SUBSTRATE

BACKGROUND OF THE INVENTION

1. Field of the Invention

The present invention relates generally to an electrographic apparatus and more specifically to an improved structural arrangement in an electrographic apparatus of the type having a resistive charging device with scorotron characteristics, which arrangement achieves generation of a corona.

2. Description of the Prior Art

In electrostatographic applications such as in xerography, a charge retentive surface is electrostatically charged, and exposed to a light pattern of an original image to be reproduced to selectively discharge the surface in accordance therewith. The remaining pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto, thus forming a permanent record of the image to be reproduced. The process is well known, and is useful for light lens copying from an original, and printing applications from electronically generated or stored originals. The process has analogs in other electrostatographic applications such as, for example, ionographic applications, where charge is deposited on a charge retentive surface in accordance with an image stored in an electronic form.

It is a common practice in electrophotography and its analogs to use wire corona generating devices to provide electrostatic fields driving various machine operations. Thus, corona devices are used to deposit charge on the charge retentive surface prior to exposure to light, to implement toner transfer from the charge retentive surface to the substrate, to neutralize charge on the substrate for removal from the charge retentive surface, and to clean the charge retentive surface after toner has been transferred to the substrate. These corona devices normally incorporate at least one fine wire coronode held at a high voltage to generate ions or charging current to charge a surface closely adjacent to the device to a uniform voltage potential, and may contain screens and other auxiliary coronodes to regulate the charging current or control the uniformity of charge deposited. The devices may be driven with positive or negative D.C. potentials.

Dicorotrons are A.C. driven corona devices incorporating a dielectric coating over the active coronode structure. Thus, dicorotrons provide an arrangement, which has the characteristics of an array of capacitors coupled to the air between the voltage source and the charge retentive surface. This arrangement blocks D.C. current flow from the coronode to the charge retentive surface. The charging current to the charge retentive surface at any point on the coronode surface is limited by the maximum displacement current that can be delivered by the dielectric, which provides an essentially self regulating device. Applying a large A.C. potential to the coronode creates a gaseous plasma at the coronode that is maintained by the displacement current at any point. If the plasma current exceeds the displacement current at any point along the coronode, such as in the case of a non-uniformity caused by dust or debris on the coronode, the plasma potential drops and the plasma current is quenched at that point. If the plasma current is too low, the plasma potential rises and the plasma current is forced to increase. As a result of this action, the overall discharge from the coronode to the surface tends to be uniform since each point on the coronode surface delivers the same net charge per unit area to the plasma as every other point during each voltage reversal. Any current extracted from the plasma to charge the charge retentive surface is therefore uniform and the device tends to be stable because of its self regulating behavior.

By contrast, D.C. driven bare wire devices such as corotrons have a tendency to arc at non-uniformities along the coronode which, in effect, causes each point along the coronode to compete for current at the expense of adjacent areas. Thus, non-uniformity has an effect of reducing the available corona current along the entire coronode. This effect has a tendency to be more pronounced in negative charging devices.

Another technique employed, commonly referred to as a "scorotron," is described in U.S. Pat. No. 2,777,957. The main basis for the scorotrons design is to limit the charge potential on a surface by using a wire grid or screen placed between the corona discharge wire and the surface. The grid is maintained at a predetermined potential and serves to terminate further charging of the surface when the surface potential on all portions of the surface being charged corresponds to the grid potential. The grid can be grounded or biased by means of an external voltage source, or it can be self-biased from the corona current by connecting the grid to a ground arrangement through current flow restricting devices (an example of the latter being illustrated in U.S. Pat. No. 3,729,649). Superior image reproductions are obtainable only when very uniform electrostatic charges are established on the surface before imaging.

Thus far it has been demonstrated that it is known in the copying art to use corotrons, di-corotrons, scorotrons or other similar corona generating devices. For example, U.S. Pat. No. 4,879,569 discloses a charge generating device having improved reliability and predictability of electrical discharge. It further discloses to provide a print cartridge for use in a charge transfer imaging having improved reliability and predictability of image creation. This is done by providing a print cartridge with increased efficiency by directing a greater portion of the charged particles created towards the image receiving surface. That patent discloses an arrangement of laminates comprised of a dielectric material, such as glass reinforced epoxy. The underside of the dielectric material is comprised of printed driver electrodes. The driver electrodes are placed parallel to finger electrodes, and the types of electrodes are separated by a mica strip. The arrangement provides improved reliability and predictability of an electrical discharge. It also yields increased efficiency, such that a greater portion of charged particles are directed towards an image receiving surface.

U.S. Pat. No. 4,811,158 discloses the idea of using a solid state charger having covered electrodes with dielectric and uncovered discharge electrodes disposed parallel to each other. The covered electrodes and the discharge electrodes are both disposed on the same surface of an insulating substrate. An AC voltage is applied between the covered electrodes and the discharge electrodes, or between the covered electrodes, and a DC voltage is applied to the discharge electrodes for charging photosensitive members in electrostatic recorders.

U.S. Pat. No. 4,783,716, discloses an apparatus for electrically discharging or charging a member to be discharged or charged. The device includes a dielectric member, first and second electrodes embedded in the dielectric member. The first and second electrodes being supplied with an alternating voltage therebetween to cause discharge of an adjacent part of a surface of the dielectric member at a predetermined discharge starting voltage. A third electrode, disposed to or adjacent a part of the surface of the dielectric member at such a position as when the discharge occurs by application of the alternating voltage between the first and second electrodes, no discharge occurs between the first electrode and the third electrode or between the second electrode and the third electrode.

Another example is U.S. Pat. No. 4,779,107, which discloses a marking array for use in an ionographic marking apparatus in which the ion modulation structure is subject to a lightly corrosive atmosphere. Improved marking electrodes are provided which comprise a thin film body of a conductive material having a surface which is chemically neutral to the corona effluents.

U.S. Pat. No. 4,562,447 discloses the use of an ion modulating electrode having at least one row of a plurality of apertures, which is capable of enhancing or blocking the passage of an ion flow through said apertures. The ion modulating electrode comprises a continuous layer of a conductive material and a segmented layer of a conductive material separated from each other by an insulating layer. The ion modulating electrode comprises at least one of said continuous layers and the segmented layer has a resistance layer.

The current invention is an improvement over U.S. Pat. No. 4,794,254, having common inventors and assignee as the present application, which is herein incorporated by reference in whole. That patent discloses a distributed resistance corona charging device. In particular, this corona charging device included an insulating substrate, a resistive material layer deposited on the substrate to a uniform thickness, and a plasma gap separating the resistive material layer into at least two resistive material regions. Voltage is applied to the resistive material regions through electrodes arranged on the resistive material regions so that a uniform resistance is provided between the power supply and the points on the resistive material regions immediately adjacent to the plasma gap. The distributed resistance corona generating device is inherently self regulating providing a uniform charging potential along the gap. Most notedly, this device does not use a metal wire corona electrode, and the device works like a corotron, including the inherent problems associated with corotron-type devices (such as lacking the ability to terminate charging of the surface once enough charge is built up).

Although these current corona producers (corotron, scorotron, dicorotron, and di-scorotron) perform satisfactorily, over prolonged use, say for example 150,000 cycles, difficulties are experienced for thin metal wire corona electrodes. These difficulties take the form of undeveloped streaks being formed in the copies produced resulting in unpredictable images.

As a result, the present invention provides a solution to the described problems and other problems, and also offers other advantages over the prior art.

SUMMARY OF THE INVENTION

In a first feature of the invention, there is a device for producing ions. Wherein, the device has an insulating base substrate; a first layer of resistive material uniformly deposited on the substrate; a second layer of insulating material uniformly deposited on the first layer; and a third layer of resistive material uniformly deposited on the second layer. Moreover, each of the layers are separated into first and second regions defining a plasma gap extending to the substrate.

In a second feature, there is a device for producing ions, comprising an insulating substrate, a first layer of resistive material uniformly deposited on the substrate, and a second layer of insulating material uniformly deposited on the first layer. Moreover, the device also has a plurality of parallel electrical nibs, having a coextensive surface with the insulating substrate and embedded in the second layer. Additionally, the first and second layers and the nibs have a plurality of holes extending through each of the layers and the electrical nibs to the substrate.

In a third feature of the invention there is a corona generating device for the production of ions in an electrostatographic device. This device comprises an insulating substrate, a first layer of resistive material uniformly deposited on the substrate, a second layer of insulating material uniformly deposited on the first layer, and a third layer of resistive material uniformly deposited on the second layer. Each of the layers are separated into first and second regions defining a plasma gap therebetween and extending through each of the layers to the substrate in order to generate the corona for the production of ions in the electrostatographic device.

BRIEF DESCRIPTION OF THE DRAWINGS

In the drawings, like reference numerals indicate corresponding parts of preferred embodiments of the present invention throughout the several views, in which.

DETAILED DESCRIPTION OF THE PREFERRED EMBODIMENTS

Figure 1:
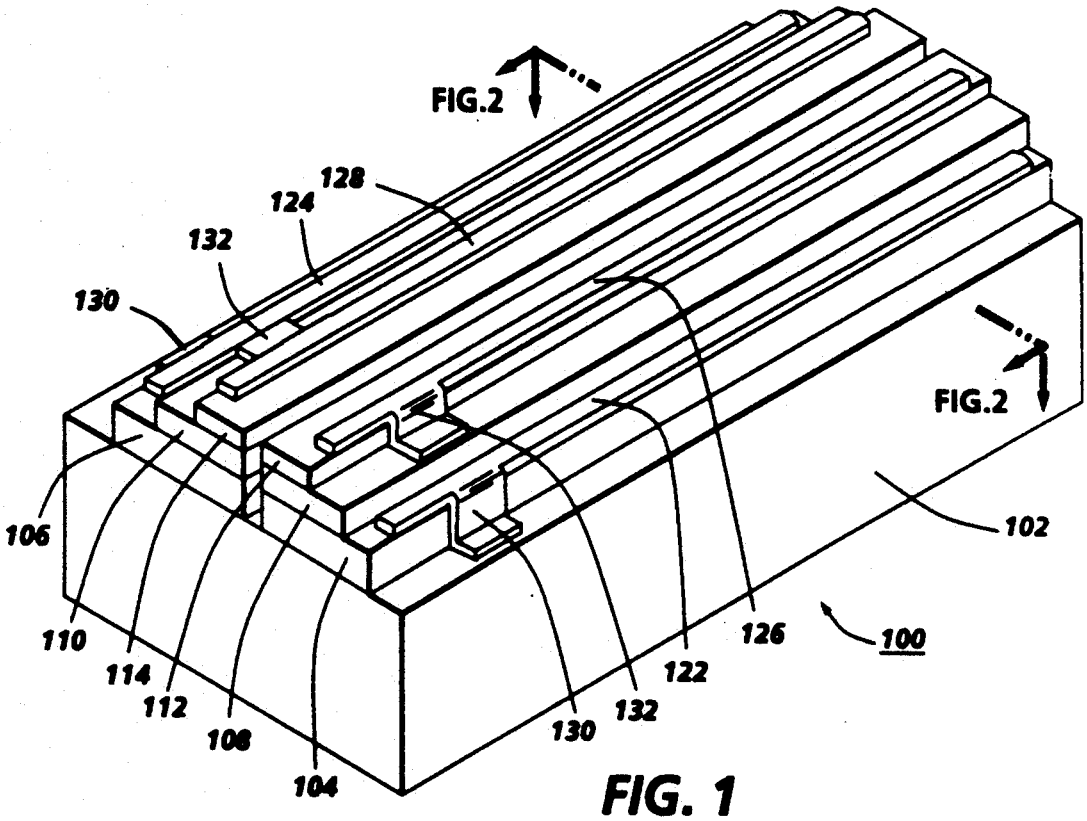
FIG. 1 is a perspective of the semi-scorotron device.
Figure 2:
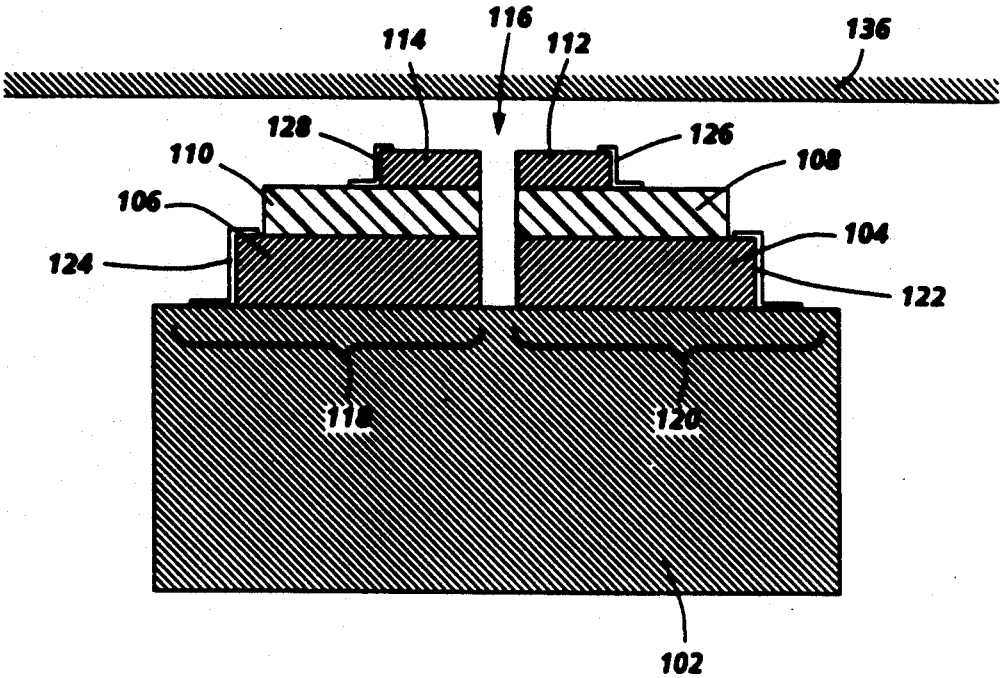
FIG. 2 is a cross sectional view of the device.

Referring now to the drawings, FIGS. 1 and 2 show a distributed resistance corona generating charging device with scorotron characteristics for producing ions, herein referred to as a semi-scorotron device 100.

The ion production can be used, for example, in many devices such as ionographic devices, copy machines, printers, or image output terminals. The device 100 comprises several layers, an insulating substrate 102 comprised of glass or a glass-like material such as alumina forms a base and has three layers deposited on top. First, a resistive material first layer 104 and 106 is uniformly deposited on said substrate. Second, a dielectric insulating material second layer 108 and 110 uniformly deposited on said resistive material layer. Third, a resistive material third layer 112 and 114 uniformly deposited on said dielectric insulating material, comprising the similar material as the first coating having a resistive nature although not necessarily required to have nearly as high a resistance value. The operable portion of the device has a length which corresponds to the width of a surface to be charged, like a charge retentive surface. The width of the device is variable with the needs for placement in a system, and to economically manufacture the device.

In one embodiment, the resistive material layers may be a thick film resistive paint or ink approximately 1 mil in thickness which is kiln hardenable at 500–850 degrees C. to a glassy or ceramic finish, resistant to most abrading or casual cutting contact. Satisfactory materials are available from the DuPont Corporation, Wilmington, Del., under the trademark BIROX having a resistance on the order of approximately 1 to 100 megohms per square inch at the described thickness. Resistive materials suitable for use range in resistivity from below 1 to 1000 megohms per square inch. In the simplest case, the materials may be painted, dipped, or spun onto the substrate. Alternative fabrication materials and techniques producing resistive and insulating layers or films can be used instead. For example, it is well known that sputtering thin film resistive materials onto a smooth substrate produces superior coating uniformity and is preferred as a fabrication process where uniformity is critical.

Moreover, in a preferred embodiment, the middle or second layer comprising the dielectric insulator may also be a thick film insulator paint or ink. This material is also available from the DuPont Corporation, Wilmington, Del., under the trade name "Multilayer dielectric composition 5704."

In one embodiment, as seen in FIG. 2, in order for a corona to be generated the semi-scorotron device has a plasma gap 116. Gap 116 is formed through all three layers and may extend into the depth of substrate 102, thus separating the layers into two distinct regions 118 and 120, coextensive with gap 116. A suitable gap may preferably range in thickness from approximately 2–10 mils, with the smaller gap sizes requiring lower driving voltages and producing greater output uniformity, although gap thicknesses from 0.5 to 20 mils may be useful. The gap may be formed in the layers by a deposition method onto the substrate or by subsequently cutting (via laser or diamond saw) through the layers.

With further reference to FIGS. 1 and 2, conducting electrodes 122, 124, 126 and 128 extend along the length of each resistive material regions 104, 106, 112 and 114, and are connected respectively through contact tabs 130 and 132 to a power supply (not shown) in order to uniformly provide a voltage signal to each point along plasma gap 116. The resistance between power supply and plasma gap 116 should be the same for each point on the electrode surface adjacent the plasma gap for the purpose of charging uniformity. To improve uniformity, the resistance from the power supply to the plasma gap may be varied by adding a conductive paint extending from the electrodes 122, 124, 126 and 128 across a portion of the resistive material region, whereby a portion of the resistive region is short circuited, and the resistance is reduced. Other methods of trimming the layers to obtain uniform resistance across the regions are certainly possible. A D.C. source operating in the range of greater than 1.5 kilovolts is preferred for use in powering the device, although an A.C. source may potentially be used. However, the applied A.C. source is partially attenuated by parasitic capacitance in the device, and is not preferred.

In one use, and with reference to FIG. 2, the semi-scorotron device may be supported for charging at a distance less than about 25 mils from charge retentive surface 136, with plasma gap 116 exposed to surface 136.

Figure 3A:
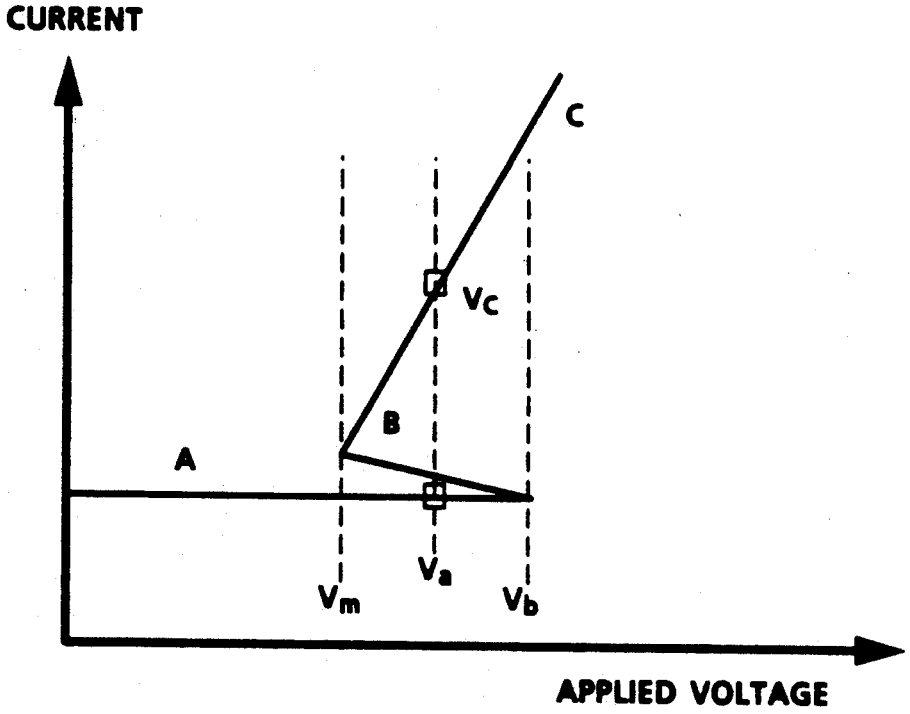
FIGS. 3*a* and 3*b* are graphs showing the relation between the current and applied voltage in the device compared to a wire corotron.
Figure 3B:
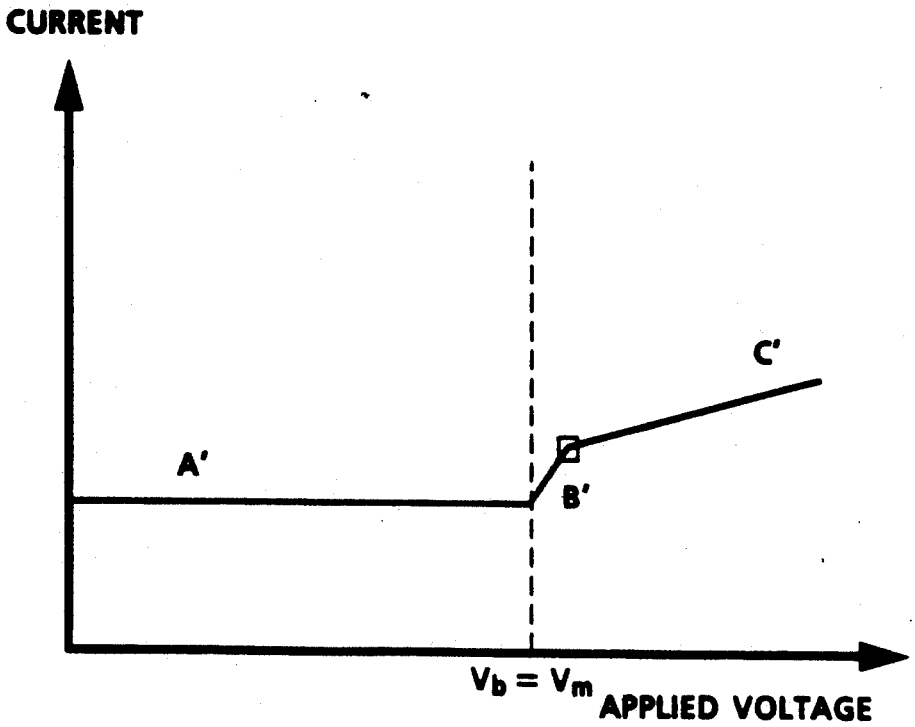

FIGS. 3A and 3B show an idealized comparison of the I-V operating characteristics of a gas discharge condition comparable to that produced by a wire coronode and the inventive distributed resistance corona generating devices. In FIG. 3A, 'V b' is the breakdown voltage of a gas (air) and 'V m' is the minimum sustainable operating voltage producing plasma current. No plasma current is produced for the voltages along line segment A to 'V b'. Segment B has a negative dynamic impedance, which is an unstable operating condition. Accordingly, stable operation and production of plasma current can occur only along segment C. Looking at the curve, however, it can be seen that, two stable operating points along the curve can be satisfied at the same applied voltage, one which produces plasma current while the other does not. Thus, for the same voltage between 'V m' and 'Vb', simultaneously along the coronode may be points of corona or no corona, depending on the plasma current condition, as demonstrated at points 'V A' and 'V C'.

In FIG. 3B, showing the operating characteristics of the semi-scorotron device, it can be seen that it can be seen that only one operating point along the curve can exist at any applied voltage. The addition of the distributed resistance has shifted segment B' from a negative slope or resistance to a positive resistance. Accordingly, the semi-scorotron device is operable at any voltage greater than 'V m', including the segment B'.

Figure 4A:
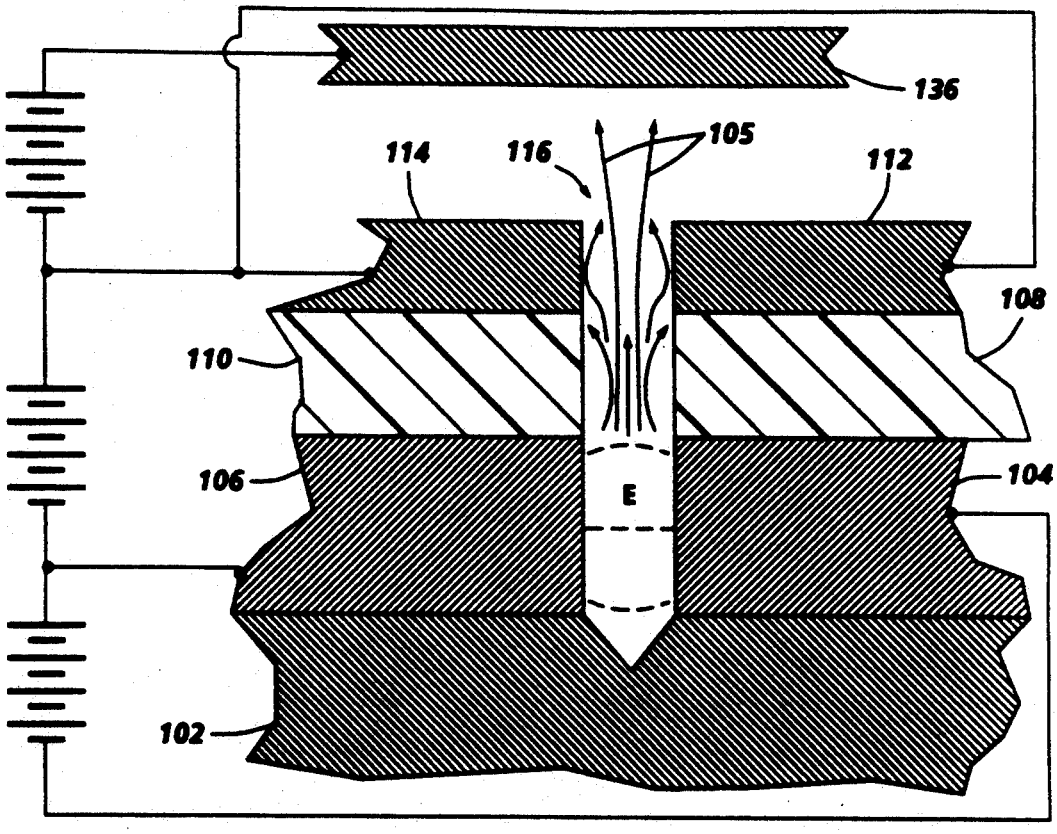
FIGS. 4*a* and 4*b* are sectional views of the device showing power sources.

In a first embodiment, as demonstrated in FIG. 4*a*, electric field E generated at plasma gap 116 is usually directed approximately from one exposed edge of the first resistive material layer 104 towards the opposite exposed edge of the other resistive material layer 106. This is done by applying a potential difference between layer 104 and layer 106 large enough to initiate a plasma in the strong field E of gap 116. This plasma in the strong field region E consists of electrons and ionized air molecules. Charge retentive surface 136 initially has a lower potential than either layer 104 or 106 tending to attract ions away from the vicinity of plasma flux region E. Free ions 105, that have drifted or been injected from the plasma into the surrounding region of gap 116, will be propelled to surface 136. Due to the continuous nature of the plasma discharge, there is a continuous supply of ions 105 that are available for deposit on surface 106. This continuous supply of ions is the root of the problem concerning a lack of control over the charge density deposited onto surface 136 and its resulting uneven potential. The flow of ions attracted to surface 136 is regulated by the outer resistive layers, generally referred to by reference number 115, which comprise layers 112 and 114. Specifically, layer 115 works in two ways. First, if layer 115 has a relatively lower potential than surface 136, ions 105, having been injected or drifting in the volume between surface 136 and layers 115 as well as ions 105 in gap 116, will be attracted to layer 115 and not to surface 136. In contradistinction, when layer 115 has a higher potential than surface 136, those ions 105, injected or drifting in the volume between surface 136 and layers 115 as well as an appreciable fraction of ions 105 in gap 116, will be attracted and reach surface 136. Ion flow control arises from the variance of the changing potential of surface 136 as ions 105 are deposited and charge it up over a time period. Specifically, surface 136 starts out at a lower potential than third layer 115. It follows that as ions 105 are deposited upon surface 136 the relative potential of surface 136 rises, and eventually this potential will approach the same potential as third layer 115. As a result, ions exiting gap 116 are equally as likely to be attracted to surface 136 as to third layer 115. Consequently, ion 105 deposition rate onto surface 136 is substantially slowed down. Moreover, as the potential of surface 136 becomes even slightly higher as a result of the slower ion 105 deposition, more and more ions 105 will be attracted to the lower potential of third layer 115 instead of surface 136. Thus, as described, third layer 115 acts as a regulator of the flow of ions that will be deposited on the surface 136 that result in a cumulative surface charge of the same potential as applied to layers 115. One skilled in the art will appreciate that this arrangement works much like a scorotron grid arrangement, though using resistive materials as in the semiconductor industry instead of a metal grid.

The above described embodiment is referred to as a horizontal flux field because of the orientation of flux field E. Conversely, in yet a related embodiment, as demonstrated in FIG. **4*b*, electric field E works in a vertical fashion. Specifically, in this vertical field arrangement, layers 104 and 106 are of equal potential and both supply plasma current flowing upwards in gap 116. Meanwhile, layers 112 and 114 are at equal potential which is intermediate between that of surface 136 and layers 104 and 106. As a result, plasma flux field E extends from the lower layers 104 and 106 towards layers 112 and 114. Consequently, as discussed in the horizontal arrangement, ions are generated by plasma field E. However, unlike the horizontal field arrangement, a vertical field arrangement is better suited to aid in propelling ions 105 into gap 116 and on toward surface 136. Specifically, the plasma flux current itself consists partially of a high concentration of ions being propelled by strong electric field E and flowing from layers 104 and 106 toward layers 114 and 116. Thus an appreciable fraction of ions 105 are emerging from the plasma arising from field E into gap 116 which already have a trajectory towards surface 136. These emerging ions 105 are further accelerated by the electric field at the mouth of gap 116 and in the volume between surface 136 and layers 115 causing them to reach surface 136. Thus the co-linear direction of both plasma field E and the external accelerating field combine to advantageously enhance the probability of ions being injected from the plasma into the mouth of gap 116 where they are available for acceleration to surface 136. Therefore, when attracted toward surface 136, relatively more of ions 105 can be deposited in a given time than can the horizontal arrangement. (The flow of ions attracted to surface 136 is regulated by the relative potential between resistive layers 115 and surface 136 through the same regulation mechanism as has been described immediately above for the horizontal flux field embodiment.) As for the remaining capabilities of this arrangement, there are no differences between the horizontal or vertical field operations concerning the scorotron-like grid characteristics and control of the ion 105** deposition.

Figure 5:
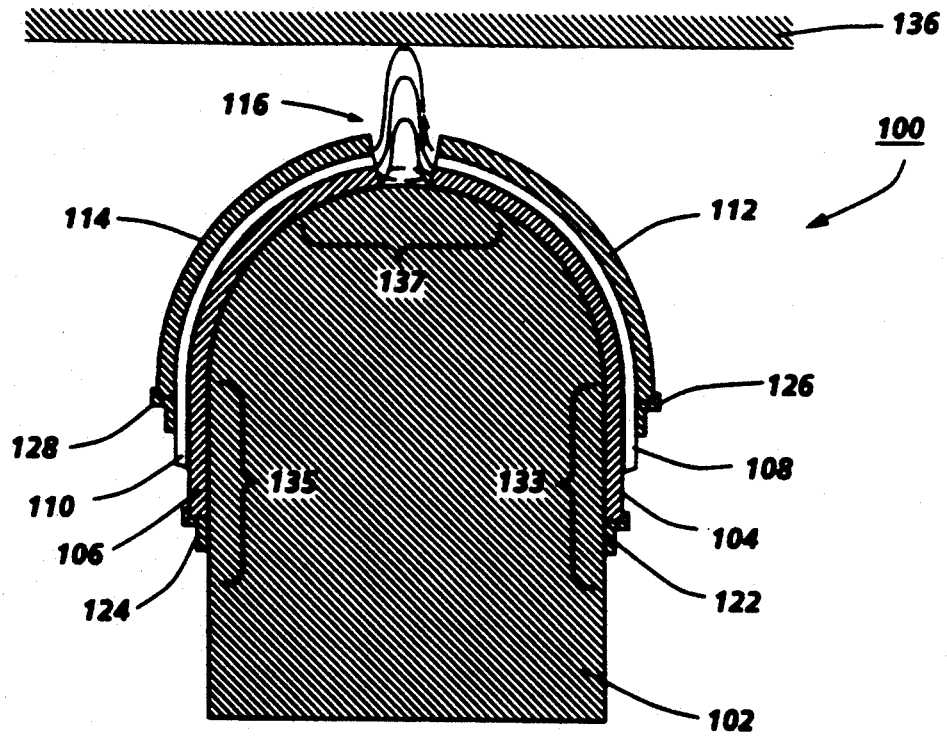
FIG. 5 is a cross sectional view showing an alternative device configuration.

In accordance with another embodiment of the invention, and with reference to FIG. 5, the invention can be formed into a folded or knife edge semi-scorotron device. The folded design has a first 133 and second 135 oppose sides and connecting side 137 joining the first and second sides. The advantage of the knife edge design is that the accelerating fields in the volume just outside the mouth of gap 116 are concentrated and consequently intensified due to their necessarily outward divergence from the narrow knife edge. Therefore, this geometric arrangement increases the number of ions likely to move towards surface 136 using either the horizontal or vertical arrangement. Additionally advantageous, electrical connectors or electrodes 122, 124, 126 and 128 are moved around to the sides, thus enabling plasma gap 116 to be physically closer to surface 136. In operation, the knife edge design uses the same principles as have been previously described; namely, using a horizontal or vertical plasma flux arrangement with similar control mechanisms.

In yet another embodiment of the invention, and with reference to FIG. **6*a*, the semi-scorotron device may be provided with differentially driven portions of plasma gap 116, which provides differing charging functions along the length of gap 116. Concerning the arrangement of this embodiment, semi-scorotron device 100 is provided with an insulating substrate 102, having the same resistive material layer and dielectric layering as described for the prior figures. The resistive material layers are divided into the two regions 118 and 120 by a plasma gap 116 extending through the resistive and dielectric material coatings to the substrate as before. Region 118, or layers 104, 108, and 112, is connected to a low potential side of a power supply (not shown), in a manner providing a uniform resistance between each point on plasma gap 116 and the associated electrodes. Of particular note, region 120 is provided with a plurality of region segments 138, 140, 142, 144, and 146, corresponding to layers 106, 110 and 114**. Each segment is electrically isolated from adjacent segments by one of a variety of ways. For example, by providing large enough gaps so as to inhibit arcing. Moreover, by filling the gaps with dielectric material the segments may also be electrically isolated.

Concerning electrical source connection, these segments may be separately connected via different controls to a single power supply (not shown). Alternatively, instead of having one power supply, separate power supplies can be provided. This arrangement in turn produces a plasma at plasma gap 116 which is located coextensive to each segment.

This embodiment takes advantage of the fact that the invention may be closely spaced to surface 136 (not shown), and in at least one embodiment the device may be spaced less than 25 mils. This close spacing advantageously allows for a charged area to have very sharp and well defined boundaries, as well as having little dissipation of the charging current outside of this selected charged area most proximate to plasma gap 116.

As a consequence of this close proximity, an arrangement is achieved which is suitable for charging a charge retentive surface 136 in accordance with the width size to match a toner image which will eventually be transferred. Specifically, central segment 142 is driven separately from edge segments 138, 140, 144, and 146, which may, for example, be driven or not driven in accordance with selected width sizes. Additionally, end segments 138 and 140 may be paired with counterpart segments 146 and 144, respectively, on the opposite side of the central segment 142. This pairing arrangement provides a non-charging condition at the width edges which advantageously eliminates the need for edge erase mechanisms or interdocument lamps which are traditionally needed to dissipate charges located in areas adjacent to the desired image formation. Alternatively, these selected paired segments are energized, thus enabling a plasma producing condition, when a greater proportion of the charge retentive surface width to be charged is required.

Figure 6A:
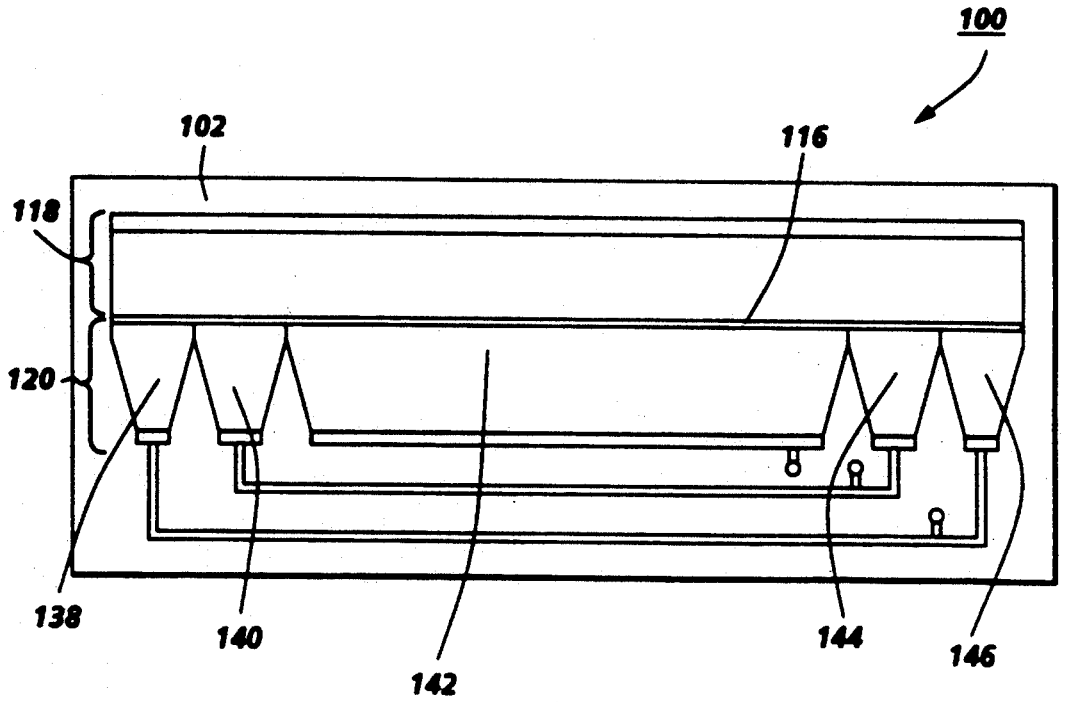
FIGS. 6*a* and 6*b* are elevational views of alternative embodiments.
Figure 6B:
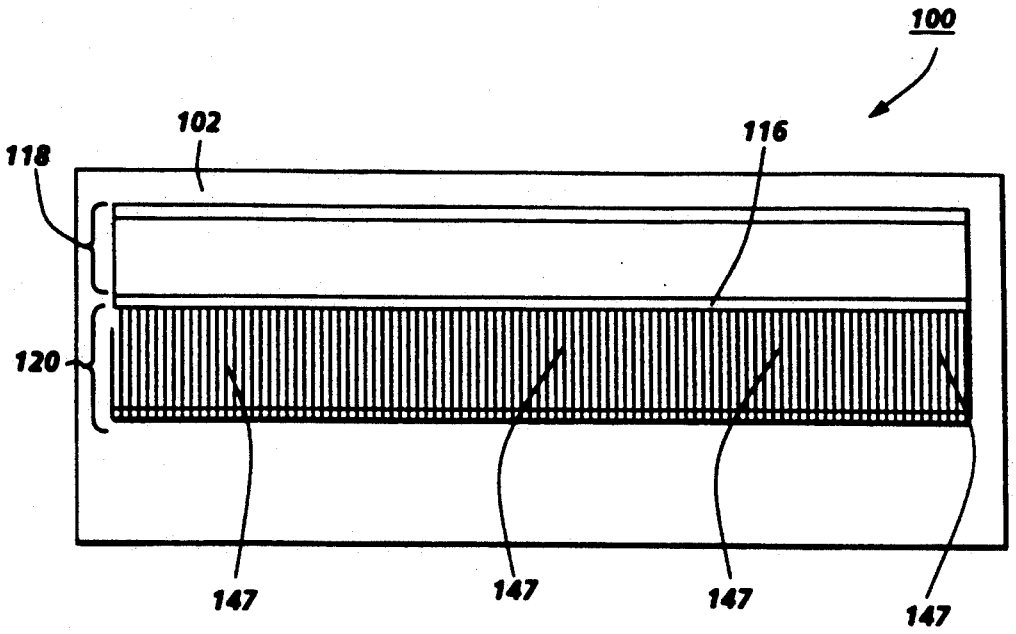

Another embodiment of the invention, as seen in FIG. 6*b*, provides a large number of segments selectively controlled to apply a charge of ions 105 to surface 136 in an annotation or printing scheme. Concerning the arrangement of this embodiment as seen in FIG. 7*b*, semi-scorotron device 100 is provided with the same insulating substrate 102, resistive material layers and dielectric layering as described for the prior figures. As before, the resistive material layers are divided into two regions 118 and 120 by a plasma gap 116 extending through the resistive material and dielectric material to the substrate. Again, region 118 is connected to a low potential side of a power supply (not shown). Moreover, region 120 is provided with a plurality of region segments 147, corresponding to layers 106, 110 and 114. Segments 147 are electrically separated as discussed in the previous embodiment. In operation, and in accordance with the annotation required, segments would be selectively driven to charge relatively small areas of the charge retentive surface. These areas may now be developed as an annotation or printing on the surface. These segments may be separately connected via controls that are linked to a power supply (not shown).

Figure 4B:
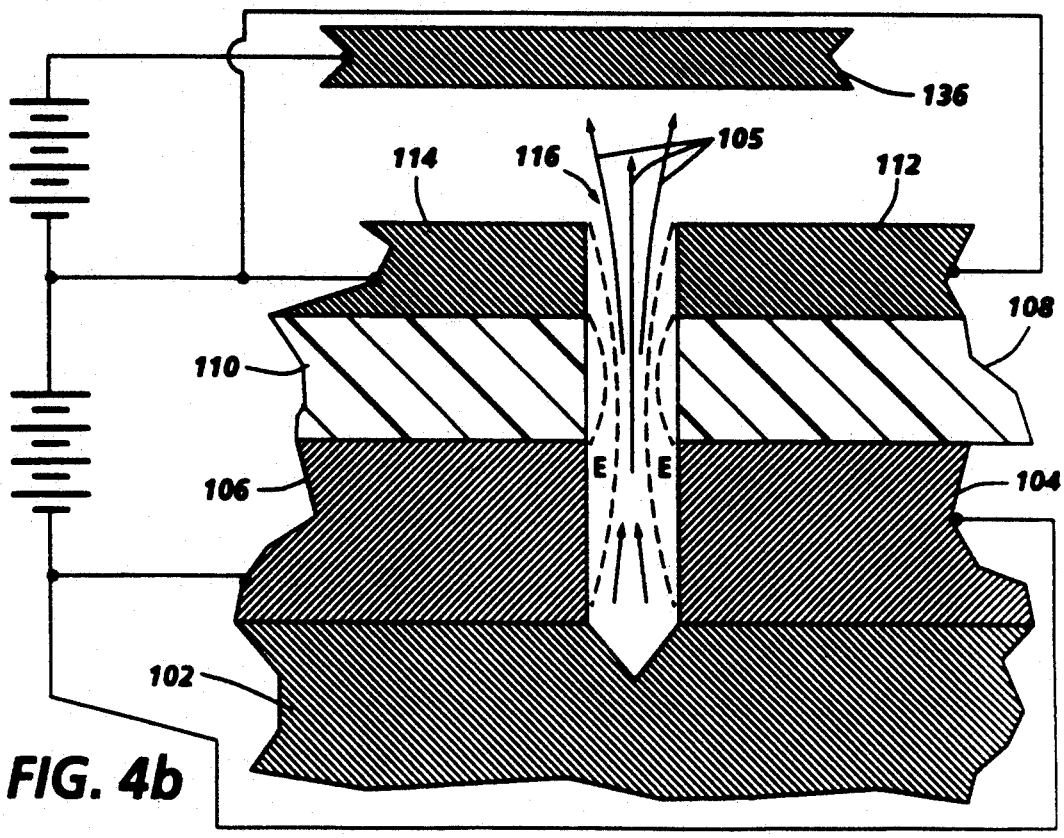
Figure 7A:
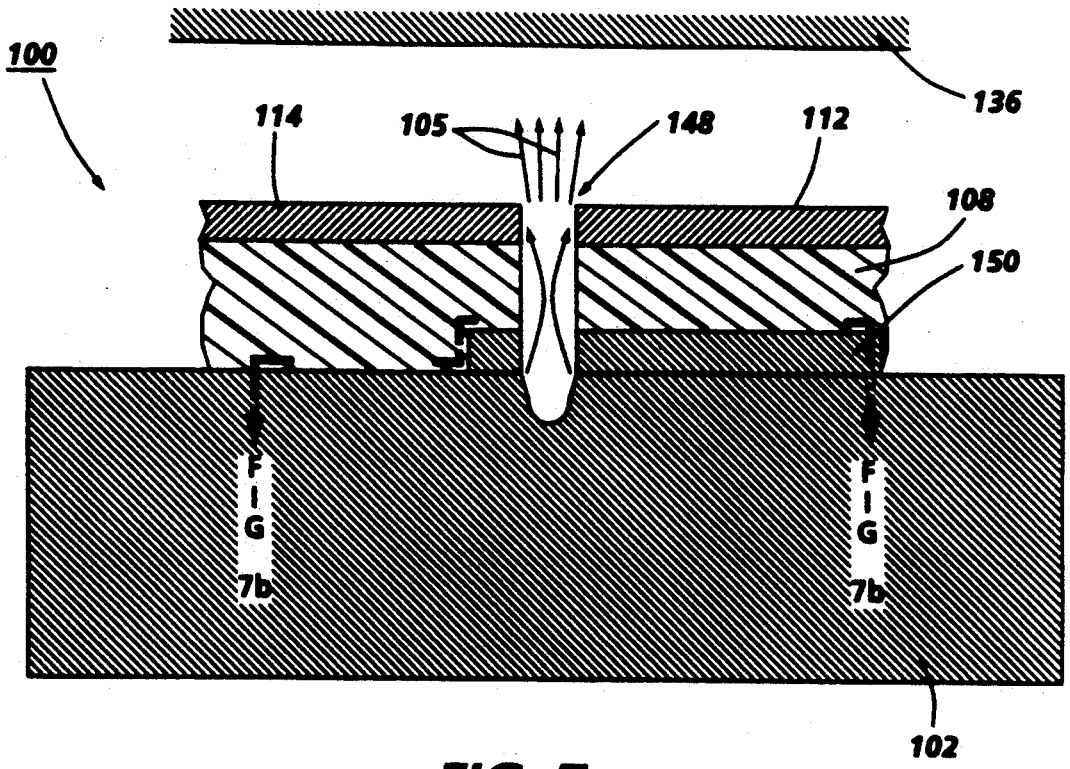
FIGS. 7*a* and 7*b* are sectional drawings of another embodiment.
Figure 7B:
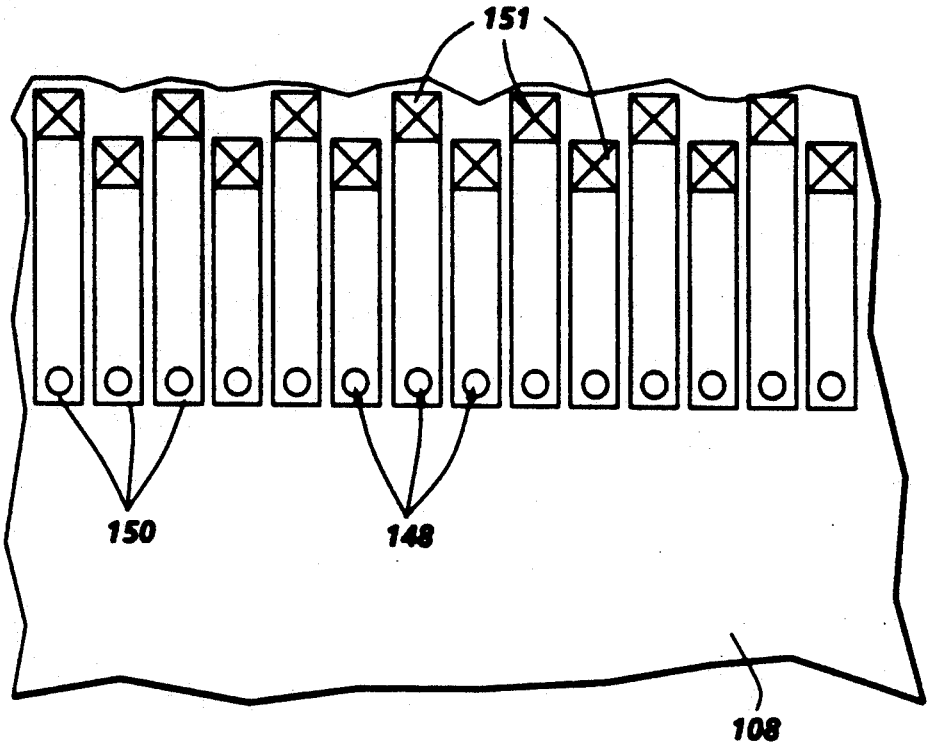

In yet another embodiment, shown in FIGS. 7*a* and 7*b*, a line of individually spaced holes 148 extend widthwise where plasma gap 116 would be. Beneficially, by providing holes for the ions to generate, there will be no cross linking or over spraying of ions into adjoining holes. In this arrangement, the electronic fields flow in a vertical upward direction, as discussed concerning FIG. 4*b*, in order to liberate more ions to surface 136. As previously described, the semi-scorotron is arranged as before except that there are holes 148 extending through the three layers and that there is a series of parallely arranged electrical nibs 150 extending from individual electrodes, generally referenced as elements 151. Electrical nibs 150, lie on top of substrate 102 and embedded in layers 104 and 106. Thus, in operation, by selectively energizing a single nib or a plurality of selected nibs along the line of individually spaced holes, it will be possible to ionize selected areas on surface 136 (not shown). Advantageously, this arrangement is suitable for electronic pixel data or printing scheme as commonly found in computer generated information. Although the figure shows the holes to be midway on the semi-scorotron, this does not have to be the case, many other positions are workable dependent on the type of application. It is noted, in FIG. 7*b*, it is also possible to have nibs 150 arranged so that they come from both sides of where holes 148 are aligned. Thus, enabling electrical elements 151 to be contacted on two sides of scorotron 100.

Figure 8:
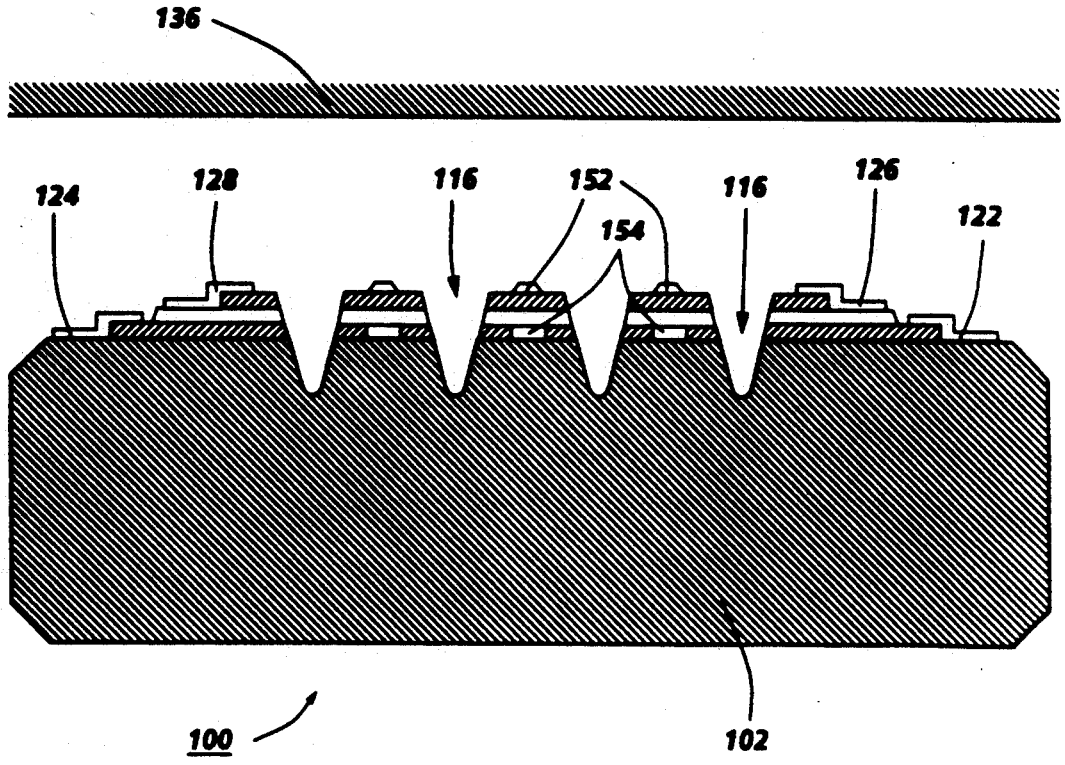
FIG. 8 is a sectional view of an embodiment showing multiple plasma gaps.

Finally, in another embodiment, the present invention is adapted to accommodate a plurality of plasma gaps 116, as for example shown in FIG. 8. This plural plasma gap arrangement acts as several parallel semi-scorotron devices, thus increasing the applied current and reducing the chances of irregularities in charging uniformity. In operation, a layer of ions 105 (not shown) are deposited onto surface 136 by a first plasma gap 116, wherein as surface 136 proceeds to the location of a second and subsequent gaps 116 where another layer of ions 105 are directed towards surface 136. However, concerning the exposure of surface 136 to the second and subsequent plasma gaps 116, the scorotron-like operation of the top or uppermost layer of resistive material absorbs the excess ions 105. Therefore, only lower potential portions of surface 136 will attract ions 105; whereas, equal or higher potential surface 136 portions will be less likely to accumulate further ions 105. Thus, these excess ions 105 are reabsorbed by the uppermost layers of device 100, i.e. the scorotron-like effect. Of particular note, additional electrodes 152 and 154 are needed to provide current to the central islands between the several plasma gaps. One skilled in the art will appreciate that there are several methods of achieving energization of the various plasma gaps 116 in the central portion of device 100.

As one final note, the purpose of forming the outer layer of resistive material (rather than a metal conductor) is to quench occasional inadvertent and undesirable sparks between the device and surrounding objects, (drums, frames, etc) caused by dirt, dust, paper clips, toner deposits and the like. Putting some resistance in the outer layer (which must be fully exposed to establish the scorotron like accelerating field between the surface 136 and the device) doesn't change its equipotential nature as long as the currents flowing in the layer are small-they are essentially nonexistent in normal operation (i.e., 1 megohm × 1 microamp = only 1 volt probable difference between "here" and "there"). However the resistance serves to limit the maximum current that can flow in a spark, thereby limiting the maximum power that can be dissipated in the spark, and so protecting the device and wherever else the spark "lands".

It will no doubtedly be appreciated that other arrangements are possible which achieve the desired result. It will additionally be appreciated that while the novel ion producing distributed resistance corona device has been described with respect to its function for applying a charge to a charge retentive surface, the device has equal applicability to charging functions throughout an electrostatographic device. The invention has utility to the standard functions in electrophotographic reproduction, including charging, transfer, detack and cleaning, and charge neutralization, as well as the less standard functions such as edge or interdocument erase and annotation. The invention also has applications to the production of ions of ionography and other reproduction and printing techniques where the production of ions is desired. The production of ions in an efficient and uniform manner also has applications to polymer industry for oxidation and polymerization, and to general chemical areas where the production of ions as chemical reactants are desirable. It is intended that all such variations and uses are included insofar as they come within the scope of the appended claims or equivalents thereof.

We claim:

1. A device for producing ions, comprising:
a) an insulating substrate;
b) a first layer of resistive material uniformly deposited on said substrate;
c) a second layer of insulating material uniformly deposited on said first layer; and
d) a third layer of resistive material uniformly deposited on said second layer with each of said layers being separated into first and second regions defining a plasma gap extending to said substrate.

2. A device as defined in claim 1, wherein said insulating substrate comprises first and second opposed sides and a connecting side joining said first and second sides, wherein said plasma gap is located along said connecting side.

3. A device as defined in claim 1, wherein said first, second and third layers are separated into a plurality regions defining a plurality of plasma gaps extending through said layers to said substrate.

4. A device as defined in claim 3, further comprising conductive electrodes associated with each of said regions and being adapted to connect said first and third layers to a high voltage power supply.

5. A device as defined in claim 1, wherein said device further comprises:
a) at least said first region further divided into a plurality of separate charging segments, each charging segment contiguous to said plasma gap and electrically isolated from adjacent segments; and
b) means for providing a voltage potential between said first and second regions across said plasma gap, with each of said separate charging segments being separately driven by said voltage potential providing means to selectively produce ions at the plasma gap coextensive to said separate charging segments, said layers providing a uniform resistance across each charging segment.

6. A device as defined in claim 5, wherein said plurality of charging segments comprises a central charging segment and a plurality of side charging segments, each of said side charging segments having a corresponding side charging segment opposite said central charging segment forming a segment pair, said segment pair being driven in unison to selectively produce ions on opposed sides of said central charging segment.

7. A device as defined in claim 6, wherein said plasma gap has a width of approximately 0.5 to 20 mils.

8. A corona generating device for the production of ions in an electrostatographic device, comprising:
a) an insulating substrate;
b) a first layer of resistive material uniformly deposited on said substrate;
c) a second layer of insulating material uniformly deposited on said first layer;
d) a third layer of resistive material uniformly deposited on said second layer with each of said layers being separated into first and second regions defining a plasma gap extending to said substrate; and
e) a high voltage power supply electrically connected to said first and third layers to produce ions in the electrostatogrphic device.

9. A device as defined in claim 8, wherein said insulating substrate comprises first and second opposed sides and a connecting side joining said first and second sides with said plasma gap being located along said connecting side.

10. A device as defined in claim 8, wherein said first, second and third layers are separated into a plurality of regions to define a plurality of plasma gaps extending through said layers to said substrate.

11. A device as defined in claim 10, further comprising conductive electrodes, associated with each of said regions and said first and third layers, for connection of said first and third layers to said power supply to produce ions at the plasma gap.

12. A device as defined in claim 11, wherein the plasma gap has a width of approximately in the range of 0.5 to 20 mils.

13. A device as defined in claim 8, wherein said device further comprises:
a) at least said first region further divided into a plurality of separate charging segments, each charging segment contiguous to said plasma gap and electrically isolated from adjacent segments; and
b) means for providing a voltage potential betwen said first and second regions across the plasma gap with each of said separate charging segments separately driven by said voltage potential providing means to selectively produce ions at the plasma gap coextensive to said separate charging segments; said layers providing a uniform resistance across each charging segment.

14. A device as defined in claim 13, wherein said plurality of charging segments comprises a central charging segment and a plurality of side charging segments, each of said side charging segments having a corresponding side charging segment opposite said central charging segment forming a segment pair, said segment pair being driven in unison to selectively produce ions on opposed sides of said central charging segment.

15. A device for producing ions, comprising:
a) an insulating substrate;
b) a plurality of electrical nibs with each of said plurality of electrical nibs having a surface coextensive with said insulating substrate;
c) a layer of insulating material uniformly deposited on said insulating substrate with said plurality of electrical nibs being embedded therein;
d) a layer of resistive material uniformly deposited on said layer of insulating material, said layer of insulating material and said layer of resistive material each defining a plurality of throughholes and said plurality of nibs each defining a throughhole aligned with one of said plurality of throughholes in said layer of insulating material and said layer of resistive material to form a plurality of pockets extending through each of said layers and said electrical nibs to said substrate.

16. A device as defined in claim 15, wherein said insulating substrate has first and second opposed sides and a connecting side joining said first and second sides, with said pockets being positioned along said connecting side.

17. A device as defined in claim 16, wherein said resistive material has a resistance ranging approximately from 1 megohms per square inch to 1000 megohms per square inch.

* * * * *